US005084993A

United States Patent [19]

Dahlheimer

[11] Patent Number: 5,084,993

[45] Date of Patent: Feb. 4, 1992

[54] WORKSHEET AND SUPPORT FRAME APPARATUS

[76] Inventor: Mary L. Dahlheimer, Box 10116, Apo, N.Y. 09012

[21] Appl. No.: 597,543

[22] Filed: Oct. 15, 1990

[51] Int. Cl.[5] ..... G09F 13/00; D06C 3/08

[52] U.S. Cl. ..... 40/547; 40/603; 40/541

[58] Field of Search ..... 40/124.1, 575, 603, 40/152.1, 547, 603, 541; 38/102.1, 102.2, 102.4, 102.9

[56] References Cited

U.S. PATENT DOCUMENTS

| | | | |
|---|---|---|---|
| 800,591 | 9/1905 | Payen . | |
| 3,869,817 | 3/1975 | Bowman . | |
| 3,924,343 | 12/1975 | Johnson . | |
| 4,229,890 | 10/1980 | Dropinski . | |
| 4,451,997 | 6/1984 | Johnes . | |
| 4,578,885 | 4/1986 | Dang et al. . | |
| 4,660,308 | 4/1987 | Dang et al. . | |
| 4,726,130 | 2/1988 | Bussard . | |
| 4,922,384 | 5/1990 | Torrence | 40/547 |
| 4,975,809 | 12/1990 | Ku | 40/547 |

*Primary Examiner*—Laurie K. Cranmer
*Assistant Examiner*—Cassandra L. Hope

[57] ABSTRACT

A framework arranged in combination with a fabric worksheet stretched overlying upper and lower horizontal rails of the frame and fixedly secured to interior confronting surfaces of the frame is provided and subsequently mounted with a perimeter continuous scalloped and ruffled web mounted to a rear surface of the frame. A single or plurality of stitched patterns are formed on the fabric worksheet for subsequent mounting to a wall or underlying support surface. The invention may further include a fiber optic cable directed and formed about one or both of the stitched patterns, as well as use of a pneumatic chamber to enhance stretching of the worksheet, wherein the chamber may be mounted within a pocket provided onto a rear surface of the worksheet.

4 Claims, 3 Drawing Sheets

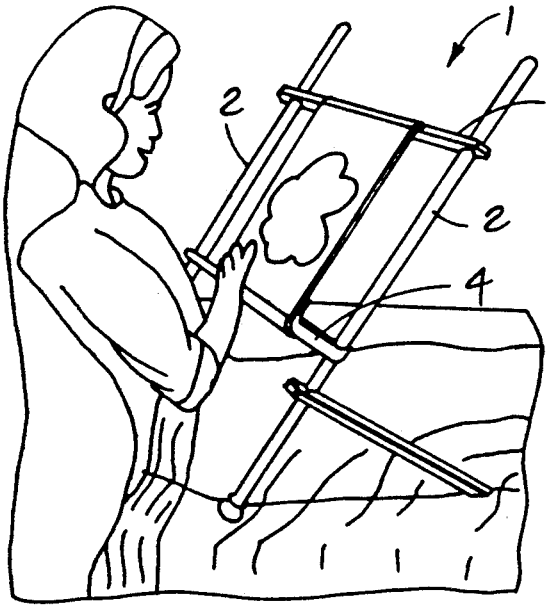
FIG 1
PRIOR ART
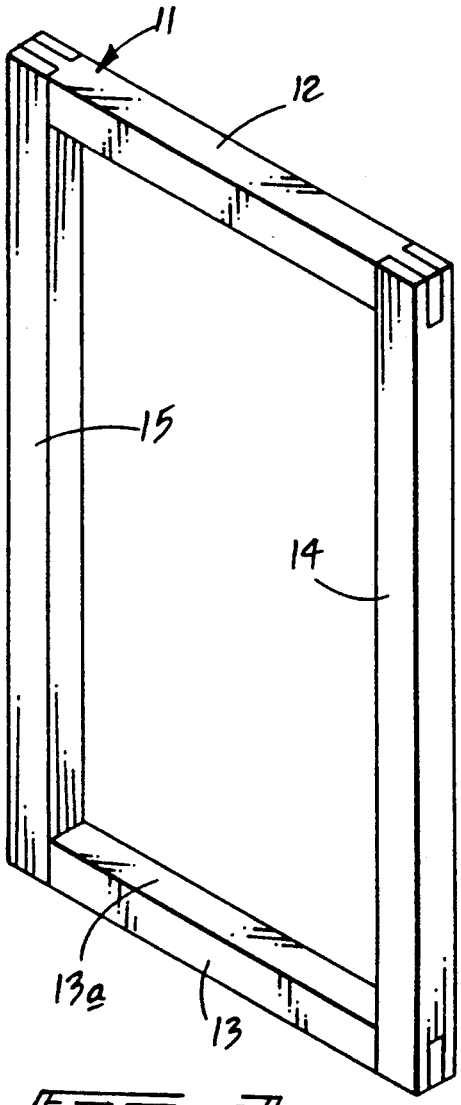
FIG 2
FIG 3
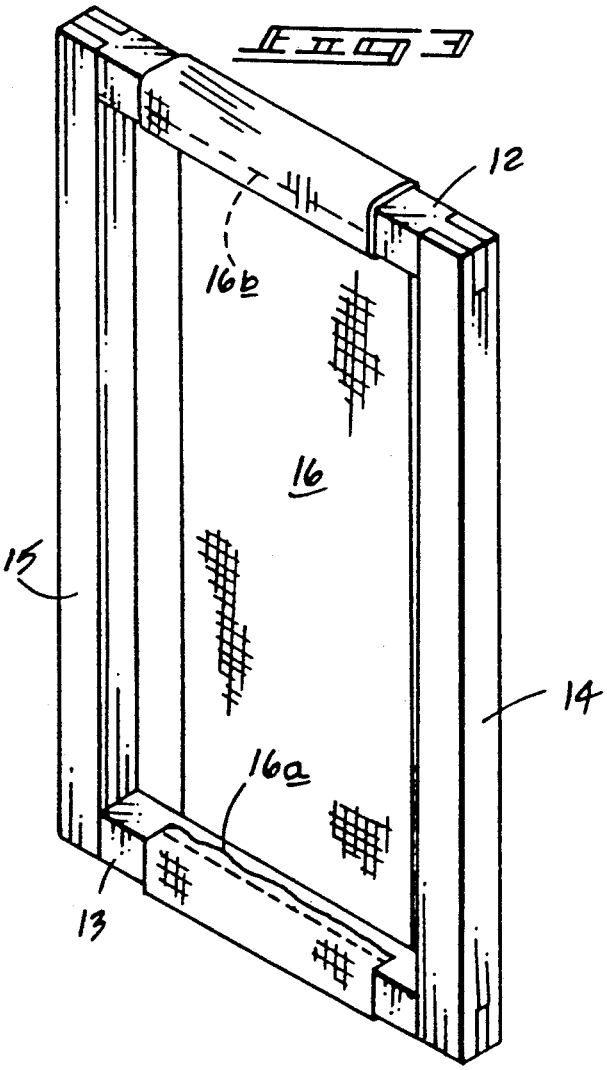

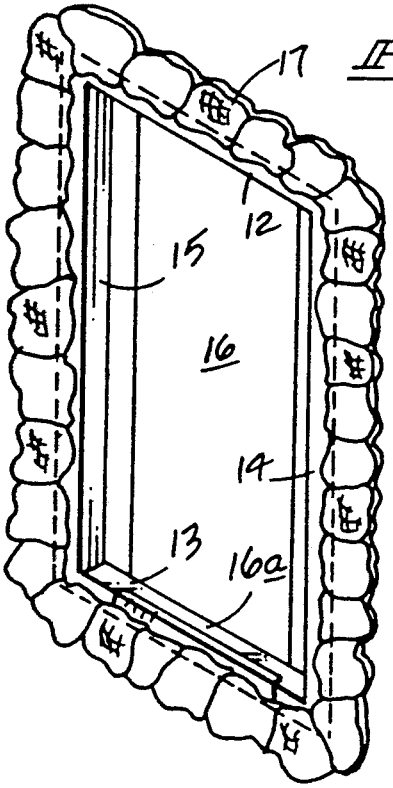
Fig 4
Fig 6
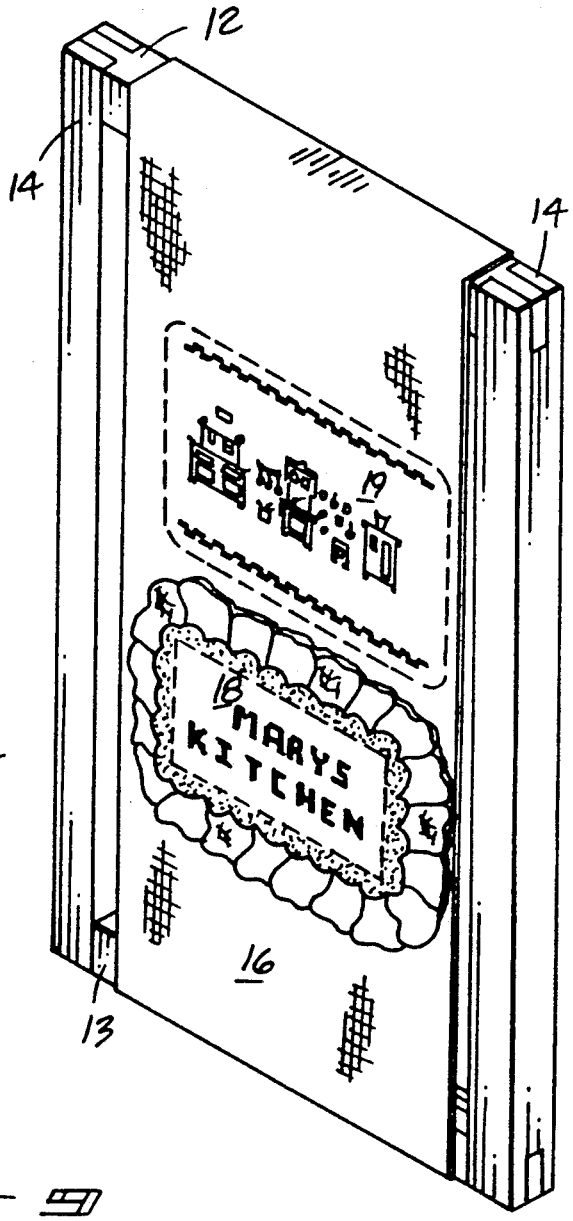
Fig 5
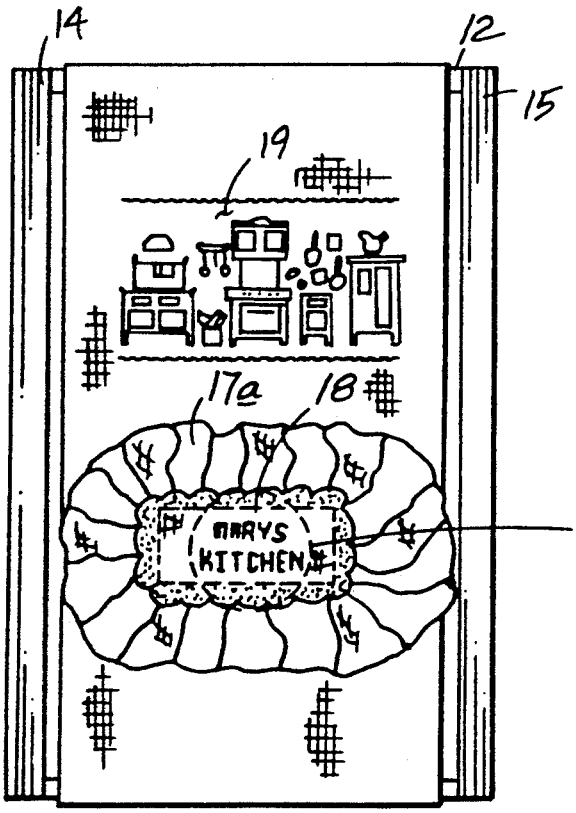

WORKSHEET AND SUPPORT FRAME APPARATUS

BACKGROUND OF THE INVENTION

1. Field of the Invention

The field of invention relates to holders for fabric to be stitched, and more particularly pertains to a new and improved worksheet and support frame wherein the same provides a frame and worksheet for fabric where stitched patterns may be placed for visual enjoyment of individuals.

2. Description of the Prior Art

Various frameworks have been provided in the prior art to form a support frame for the mounting of a fabric sheet for the stitching or embroidery procedure. Such prior art may be found in U.S. Pat. No. 3,869,817 for example that provides spaced vertical side members and a pair of parallel cross members that are slidably mounted at opposed sides of the side members to effect stretching of a worksheet mounted therebetween.

U.S. Pat. No. 3,774,326 to Selden sets forth a further example of an adjustable frame for use in a support and stretching of a canvas-type worksheet mounted thereon.

U.S. Pat. No. 3,859,742 to Amaro sets forth a frame as a further example of adjustable side members utilizing spaced apertures to effect adjustment relative to the side members.

U.S. Pat. No. 3,242,601 to Suica provides a further example of a stretch type framework that is utilized for mounting of draperies therefrom.

U.S. Pat. No. 4,660,308 to Dang, et al. sets forth a further example of a framework for mounting member therebetween.

As such, it may be appreciated that there continues to be a need for a new and improved worksheet and support frame apparatus which addresses both the problems of ease of use as well as effectiveness in construction and in this respect, the present invention substantially fulfills this need.

SUMMARY OF THE INVENTION

In view of the foregoing disadvantages inherent in the known types of support framework organizations now present in the prior art, the present invention provides a worksheet and support frame apparatus wherein the same provides for an organization mounting various fabric and mechanical components to provide for entertaining and amusement structure for mounting or support within a dwelling for enjoyment by individuals. As such, the general purpose of the present invention, which will be described subsequently in greater detail, is to provide a new and improved worksheet and support frame apparatus which has all the advantages of the prior art support framework organizations and none of the disadvantages.

To attain this, the present invention provides a framework arranged in combination with a fabric worksheet stretched overlying upper and lower horizontal rails of the frame and fixedly secured to interior confronting surfaces of the frame is provided and subsequently mounted with a perimeter continuous scalloped and ruffled web mounted to a rear surface of the frame. A single or plurality of stitched patterns are formed on the fabric worksheet for subsequent mounting to a wall or underlying support surface. The invention may further include a fiber optic cable directed and formed about one or both of the stitched patterns, as well as use of a pneumatic chamber to enhance stretching of the worksheet, wherein the chamber may be mounted within a pocket provided onto a rear surface of the worksheet.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved worksheet and support frame apparatus which has all the advantages of the prior art support framework organizations and none of the disadvantages.

It is another object of the present invention to provide a new and improved worksheet and support frame apparatus which may be easily and efficiently manufactured and marketed.

It is a further object of the present invention to provide a new and improved worksheet and support frame apparatus which is of a durable and reliable construction.

An even further object of the present invention is to provide a new and improved worksheet and support frame apparatus which is susceptible of a low cost of manufacture with regard to both materials and labor, and which accordingly is then susceptible of low prices of sale to the consuming public, thereby making such worksheet and support frame apparatus economically available to the buying public.

Still yet another object of the present invention is to provide a new and improved worksheet and support frame apparatus which provides in the apparatuses and methods of the prior art some of the advantages thereof, while simultaneously overcoming some of the disadvantages normally associated therewith.

Still another object of the present invention is to provide a new and improved worksheet and support frame apparatus wherein the same provides an organization of an amusing and entertaining structure for enjoyment by individuals.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of a prior art support framework.

FIG. 2 is an isometric illustration of the frame member utilized by the instant invention.

FIG. 3 is an isometric illustration of the framework and mounting of a worksheet thereon.

FIG. 4 is a rear isometric illustration of the framework with a continuous web thereto.

FIG. 5 is an orthographic frontal view, taken in elevation, of the instant invention.

FIG. 6 is an isometric frontal illustration of the instant invention.

DESCRIPTION OF THE PREFERRED EMBODIMENT

Figure 7:
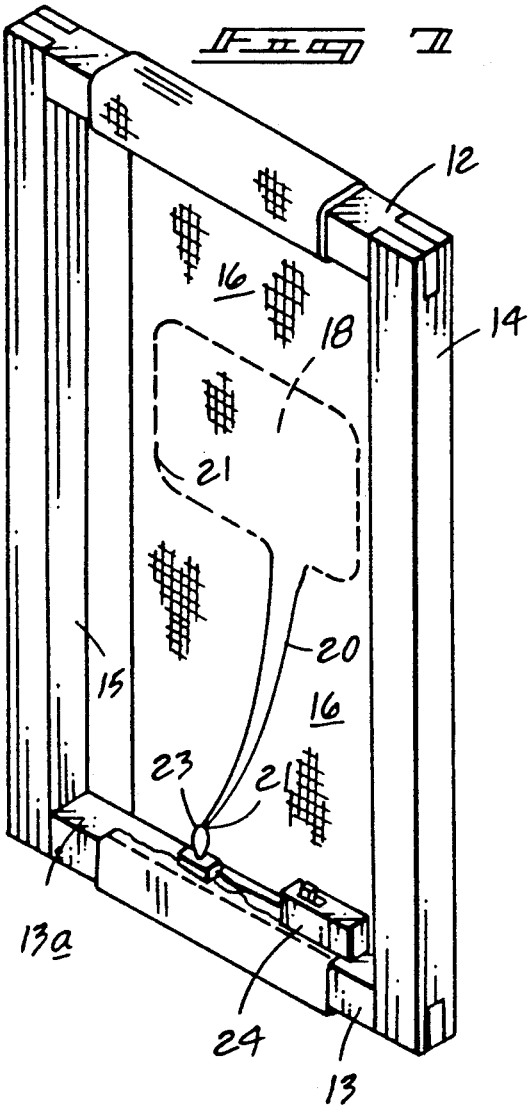
FIG. 7 is a rear isometric illustration of the organization mounting a fiber optic network thereon.
Figure 8:
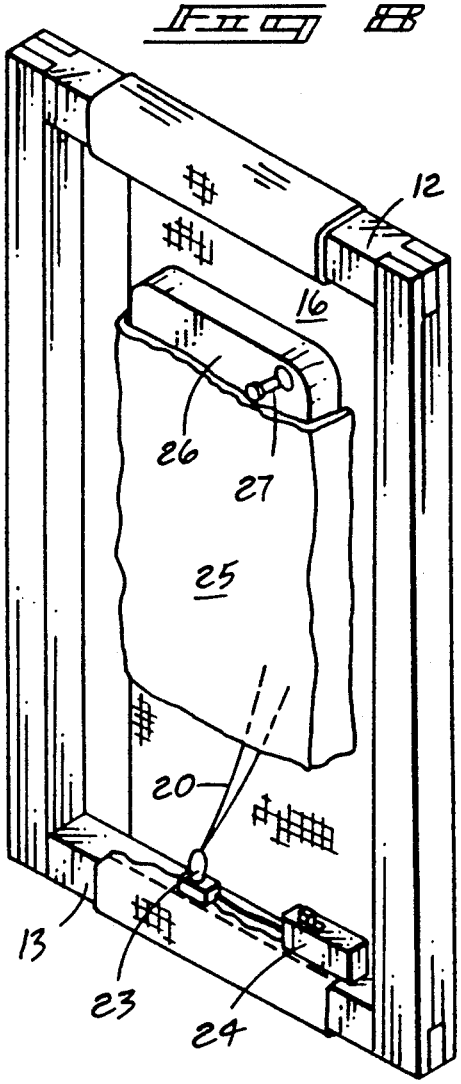
FIG. 8 is a rear isometric illustration of the instant invention further mounting the pneumatic chamber to a rear surface of the worksheet.
Figure 9:
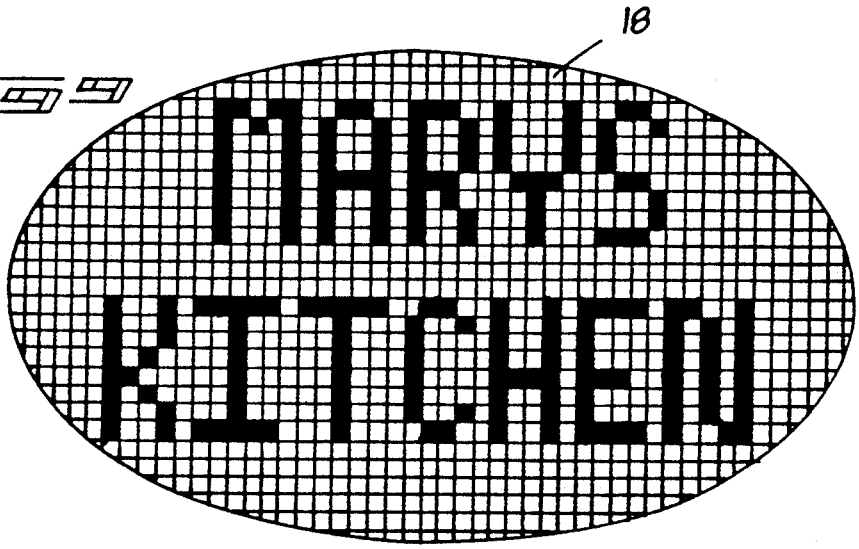
FIG. 9 is an orthographic view of Section 9, as set forth in FIG. 5.

With reference now to the drawings, and in particular to FIGS. 1 to 9 thereof, a new and improved worksheet and support frame apparatus embodying the principles and concepts of the present invention and generally designated by the reference numerals 11 through 27 will be described.

FIG. 1 illustrates a prior art support frame 1, wherein spaced side rails 2 slidably mount a top rail 3 and a bottom rail 4 to provide a stretching action to a worksheet mounted therebetween.

More specifically, the worksheet and support frame apparatus 10 of the instant invention essentially comprises an elongate frame member 11, including a top horizontal frame leg 12 spaced from and parallel a bottom horizontal frame leg 13. A first vertical leg 14 is spaced from and parallel a second vertical frame leg 15 to define the rectangular and elongate frame member 11. Each frame leg includes an interior confronting surface such as the horizontal surface 13*a* of the bottom frame leg 13 that is positioned interiorly of the frame member 11 in a face-to-face confronting relationship with a top horizontal surface of the top horizontal frame leg 12. A fabric worksheet 16 is mounted overlying forward surfaces of the top and bottom horizontal frame legs 12 and 13 and fastened to the horizontal interior surfaces 13*a* and the associated confronting surface of the top horizontal frame leg 12 to position the respective lower and upper terminal ends 16*a* and 16*b* of the fabric worksheet 16 within the aforenoted confronting horizontal interior surfaces, in a manner as illustrated in FIG. 3. Adhesive or mechanical fasteners may be utilized to effect such securement of the lower and upper terminal ends of the fabric worksheet. Subsequently, in a manner as set forth in the prior art such as typified in FIG. 1, a lower and upper stitched pattern 18 and 19 are formed within the fabric worksheet 16 that is mounted within the frame member 11. If desired, a scalloped and ruffled continuous trim web 17 is subsequently mounted to the rear surface of the frame 11, in a manner as illustrated in FIG. 4.

To enhance visual enjoyment and observation of the patterns 18 and 19, a continuous fiber optic cable 20 is mounted to a rear surface of the worksheet 16 to define a fiber optic cable framework 21 about the lower stitched pattern 18, the upper stitched pattern 19, or both of such patterns to be encompassed within the framework 20. The fiber optic cable 20 is joined at its lowermost end at a fiber optic cable junction 22 in contiguous relationship to an illumination source 23 that is selectively operative through a battery container 24 and associated switch that are both mounted to the horizontal interior surface 13*a* of the bottom frame leg 13. Further, a pocket 25 may subsequently be mounted to the rear surface of the worksheet 16 overlying the lower and upper patterns 18 and 19 and the associated fiber optic cable framework 21, wherein a pneumatic chamber 26 is positionable within the pocket and inflatable through a valve 27, wherein the pneumatic chamber, when thusly positioned, effects an enhanced stretching of the fabric worksheet 16 enhancing the stretching of the associated patterns 18 and 19 and the visual enjoyment of such patterns when the organization is mounted for subsequent use.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A worksheet and support frame apparatus comprising, in combination, an elongate frame member, the frame member including a top horizontal frame leg spaced from and parallel bottom horizontal frame leg, the top and bottom frame legs coextensively aligned relative to one another, and a first vertical frame leg and a second vertical frame leg, each arranged parallel relative to one another and fixedly mounted to the top and bottom horizontal frame legs to define a rectangular configuration, and the bottom horizontal frame leg including a bottom horizontal surface positioned interiorly within the frame member in confronting relationship to a top horizontal surface of the top horizontal frame leg, and a fabric worksheet, including a lower terminal end and an upper terminal end, with the lower terminal end fixedly mounted to the bottom horizontal surface and the upper terminal end fixedly mounted to the top horizontal surface, with the fabric worksheet mounted to an exterior surface of the top and bottom horizontal frame and stretched therebetween, and at least one stitched pattern formed on an exterior surface of the fabric worksheet between the top and bottom horizontal frame leg, and including a continuous scalloped and ruffled trim web mounted to the frame member, and wherein the trim web is mounted to a rear surface of the frame member, and including a continuous fiber optic cable mounted to a rear surface of the fabric worksheet, the fiber optic cable including a fiber optic cable framework mounted to the rear surface of the worksheet in surrounding relationship to the stitched pattern, and the fiber optic cable joined at a junction, and an illumination source positioned in contiguous relationship relative to the junction including power means to effect selective illumination of the illumination source.

2. An apparatus as set forth in claim 1 wherein the illumination source and the power means are mounted to the horizontal surface of the bottom horizontal frame leg.

3. An apparatus as set forth in claim 2 wherein the power means includes a battery container and switch to effect selective actuation of the illumination source.

4. An apparatus as set forth in claim 3 including a pocket mounted to the rear surface of the worksheet overlying the fiber optic cable framework and the stitched pattern, wherein the pocket includes a selectively removable pneumatic chamber, the pneumatic chamber including a valve to effect selective inflation of the pneumatic chamber and selective stretching of the worksheet rearwardly of the stitched pattern.

* * * * *